United States Patent [19]

Porter, II et al.

[11] 4,367,604

[45] Jan. 11, 1983

[54] MENU BOARD

[75] Inventors: Stephen T. Porter, II, Potomac; Paul G. Gaiser, Gaithersburg, both of Md.

[73] Assignee: Marriott Corporation, Washington, D.C.

[21] Appl. No.: 248,343

[22] Filed: Mar. 27, 1981

[51] Int. Cl.[3] ..... G09F 21/04

[52] U.S. Cl. ..... 40/564; 40/618

[58] Field of Search ..... 40/564, 576, 540, 616, 40/618

[56] References Cited

U.S. PATENT DOCUMENTS

| | | | |
|---|---|---|---|
| 1,120,876 | 12/1914 | Witz | 40/618 |
| 1,775,151 | 9/1930 | Aurbach | 40/618 X |
| 2,284,626 | 2/1942 | Adler | 40/140 |
| 2,284,629 | 6/1942 | Adler | 40/618 |
| 2,306,511 | 12/1942 | Wagner | 40/618 |
| 2,588,183 | 3/1952 | Vigon | 40/576 |
| 2,607,144 | 8/1952 | Harris | 40/576 |
| 2,817,914 | 12/1957 | Rosen | 40/5 X |
| 2,879,614 | 3/1959 | Baldanza | 40/576 |
| 2,939,235 | 6/1960 | Wamser | 40/618 X |
| 3,093,918 | 6/1963 | Krakauer et al. | 40/540 |
| 3,142,124 | 7/1964 | Ownbey | 40/618 |
| 3,407,525 | 10/1968 | Connell | 40/618 |
| 3,535,807 | 10/1970 | Baldwin | 40/618 X |
| 3,742,633 | 7/1973 | Palm | 40/133 B |
| 3,742,742 | 7/1973 | Palm | 40/618 |
| 3,824,726 | 7/1974 | Schubert | 40/564 X |
| 3,939,584 | 2/1976 | Trame | 40/618 X |
| 3,943,646 | 3/1976 | Branham | 40/64 R |
| 3,943,656 | 3/1976 | Branham | 40/618 X |
| 4,122,616 | 10/1978 | Witt | 40/616 |

*Primary Examiner*—Gene Mancene

*Assistant Examiner*—Wenceslao J. Contreras

*Attorney, Agent, or Firm*—Roylance, Abrams, Berdo & Farley

[57] ABSTRACT

A menu board includes a housing containing a light source, a translucent front panel and a plurality of parallel, spaced ribs with flanges attached to the face of the panel. Menu information strips are insertable between the ribs. Picture units having faces with translucent pictures thereon have opposite side walls with hook elements to engage flanges on any two ribs.

9 Claims, 12 Drawing Figures

MENU BOARD

This invention relates to a sign board, particularly of a type usable in restaurants, for displaying pictorial and alpha-numeric information.

BACKGROUND OF THE INVENTION

It is common today to have a display in a restaurant giving menu item and price information, particularly in restaurants of the type known as "fast food" restaurants. The restaurant is often arranged with a service counter to which a customer goes to order food items and behind which employees are positioned to take and fill orders. Above, or above and behind, this counter there is commonly a large sign which displays lists of items available and the sizes and prices of those items, sometimes with other descriptive information.

The sign also can, and often does, include pictorial representations of some of the food items to inform the customer about the size, characteristics and general appearance of some of the items. In recent years, these signs have been backlighted, i.e., constructed so that illumination is provided behind the alpha-numeric-bearing portions and the pictures. Selected portions of the sign are then made of translucent material and other portions are either opaque or contrastingly translucent so that the letters and numbers are readable, and the pictures are translucent in different colors, much like on enlarged photographic slide, and illuminated from behind.

when new menu items are being introduced or old ones deleted in a specific restaurant, or when price changes are necessary, it has previously been necessary to dismantle a major portion of the sign so that new alpha-numeric portions can be substituted for old ones.

This is often a difficult and time consuming procedure and one which cannot be accomplished during normal service hours. Thus, introduction of the new items is inhibited. Also, deletion of items no longer available and the indication of price changes is either inhibited or is accomplished by temporary measures (e.g., paper and tape) which results in a sign presenting a tacky, unattractive appearance.

Furthermore, previously used signs of this type are extremely limited in the sizes and positions of pictures of food items which can be incorporated in the sign and such pictures are generally not easily replaceable, if at all.

Prior art examples of sign structures are found in the following U.S. patents.

U.S. Pat. No. 1,120,876—Witz
U.S. Pat. No. 2,939,235—Wamser
U.S. Pat. No. 1,775,151—Auerbach
U.S. Pat. No. 2,284,626—Adler
U.S. Pat. No. 2,306,511—Wagner
U.S. Pat. No. 3,742,633—Palm
U.S. Pat. No. 3,939,584—Trame
U.S. Pat. No. 3,942,646—Branham

BRIEF DESCRIPTION OF THE INVENTION

An object of the present invention is to provide a sign structure capable of supporting and displaying members bearing alphanumeric characters and also pictorial representations, which members and representations are easily changeable.

A further object is to provide an illuminated sign structure capable of supporting pictorial representations of various sizes and in a variety of selectable locations.

Briefly described, the invention includes an illuminated sign structure comprising the combination of a housing having a translucent front panel; a source of light mounted in said housing; a plurality of substantially parallel ribs mounted on the outer surface of said front panel and extending across said panel in equally spaced relationship, said ribs each having, in cross section, a stem portion attached to said panel and lateral flanges extending in opposite directions from said stem portion, said flanges being spaced from said outer surface; a plurality of elongated strips each having a width less than the distance between stem portions of said ribs and a thickness no greater than the spacing between said outer surface and said flanges such that each of said strips can be inserted between adjacent ones of said ribs, at least some of said strips having opaque and translucent regions defining alphanumeric characters; and at least one picture display unit having end walls, upper and lower spaced, generally parallel side walls and a front panel, the rear of said unit being substantially open, said front panel having translucent portions forming a pictorial representation of an object, each of said upper and lower side walls having means at the rear edges thereof defining hook members shaped to engage flanges on two of said ribs which extend toward each other, said side walls being spaced apart by a distance substantially equal to an integral multiple of the center-to-center distance between said ribs.

In order that the manner in which the foregoing and other objects are attained in accordance with the invention can be understood in detail, certain advantageous embodiments will be described with reference to the accompanying drawings, which form a part of this specification, and wherein.

Figure 1:
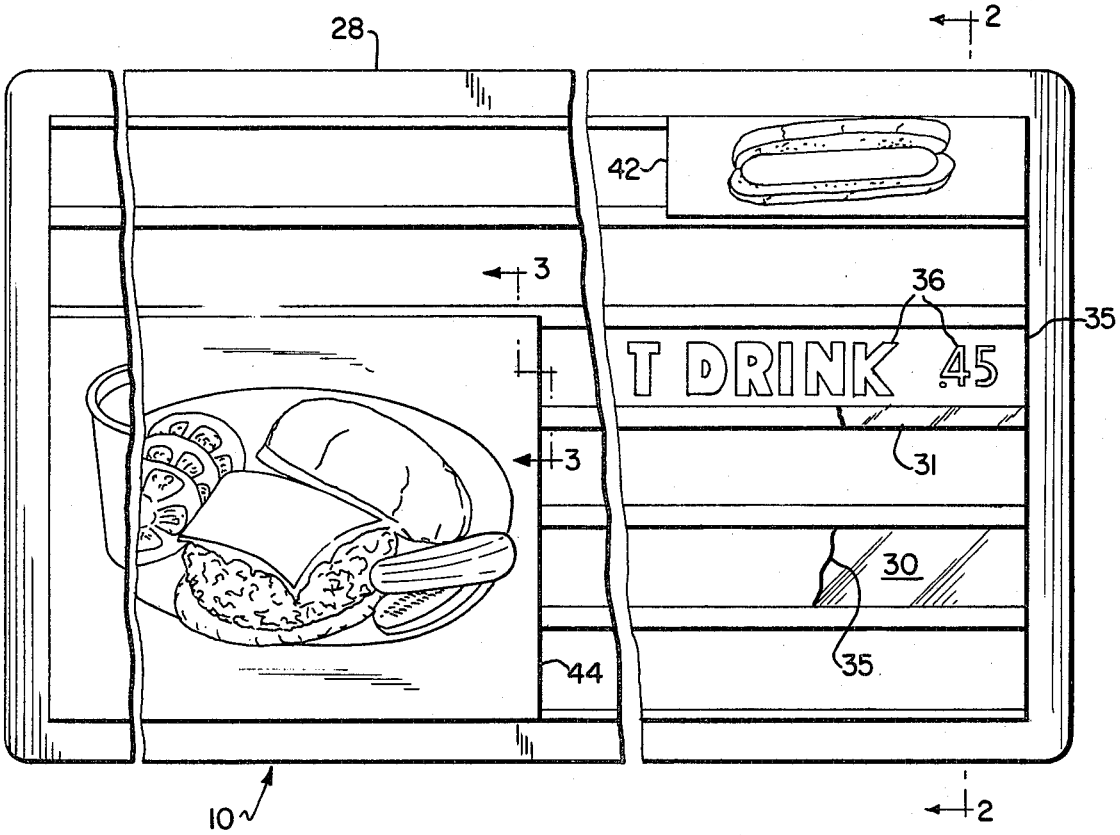
FIG. 1 is a foreshortened front elevation of a sign structure in accordance with the invention.

Referring now to the drawings, it will be seen that FIG. 1 shows a front elevation of a first embodiment of a menu board, indicated generally at 10, constructed in accordance with the invention. The FIG. 1 view is significantly foreshortened, and would normally be somewhat longer, in the horizontal direction, than it is high, although these dimensional relationships are by no means critical.

Figure 2:
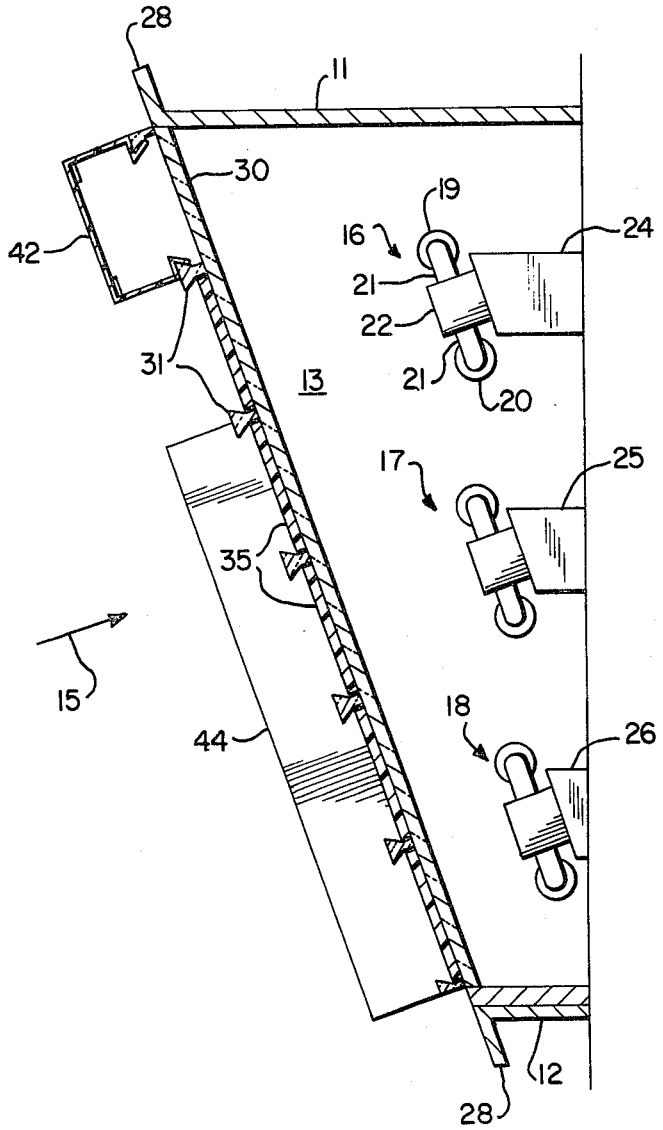
FIG. 2 is a vertical sectional view along line 2—2 of FIG. 1.

As seen in FIG. 1, and in the sectional view of FIG. 2, the apparatus includes a housing having upper and lower walls 11 and 12 and end walls 13, the housing being generally rectangular in shape, as viewed from the front, and the upper wall 11 being wider than the lower wall 12 so that the front surface of the housing is slanted, facing downwardly. The end walls are thus trapezoidal. This orientation is desirable for those situations in which, as is often the case, the menu board is placed above normal eye level. As will be seen, the view of FIG. 1 is taken at an angle as indicated by arrow 15.

Within the housing are several illumination units indicated generally at 16, 17 and 18, the units being rather conventional in nature. Unit 16, for example, includes elongated fluorescent tubes 19 and 20 which are mounted in conventional holding devices 21 on a generally parallelepipedal box 22 which contains wiring and the like for the tubes. Units 17 and 18 are similar. The units are mounted on blocks 24, 25 and 26, the front surfaces of which can be sloping to generally conform to the angle of the front of the housing. The illumination units are preferably spaced some distance, on the order of several inches, from the front of the housing to permit diffusion of the light and to avoid the creation of shadows.

At the front of the housing is a generally rectangular frame 28 which is attached to, or forms a part of, the housing walls. Mounted at the front of the housing is a front panel 30 which can be attached to the housing by any conventional fastener means such as clips or brackets. Panel 30 is preferably translucent, and in this context it will be understood that the term translucent is intended to mean that the panel transmits a major portion of light incident thereon from illumination units 16, 17 and 18. Thus the panel can be transparent, and the term "translucent" is used herein to include transparency. The panel is relatively stiff and is formed from a suitable polymeric material such as polymethylmethacrylate. Various such materials are readily available, and it will also be recognized that glass could be used, if desired. A plurality of ribs 31 are adhered to the front, outer surface of panel 30, ribs 31 being made of a material similar to panel 30. Ribs 31 extend transversely across the face of the panel and are parallel and spaced apart by equal distances, typically 1.625 inches between ribs.

Figure 3:
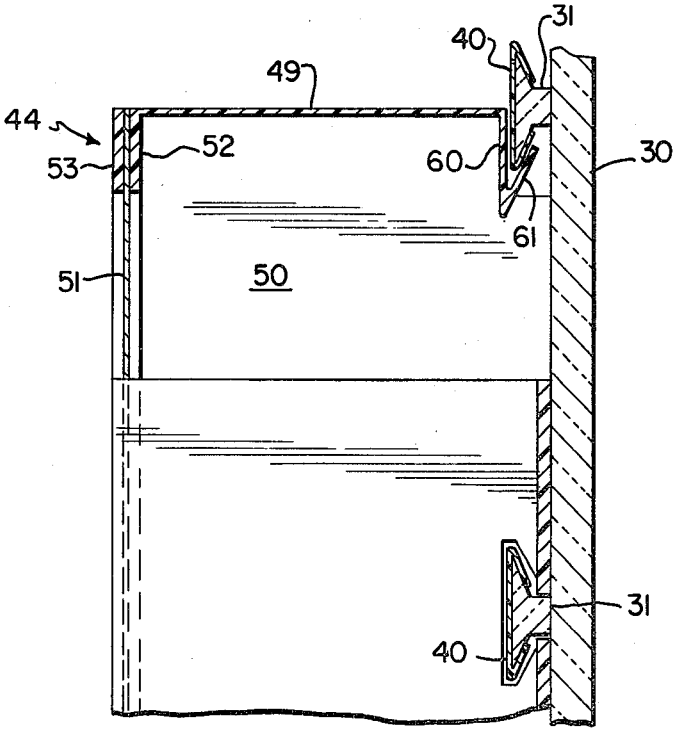
FIG. 3 is a partial side elevation, in section, along line 3—3 of FIG. 1.
Figure 4:
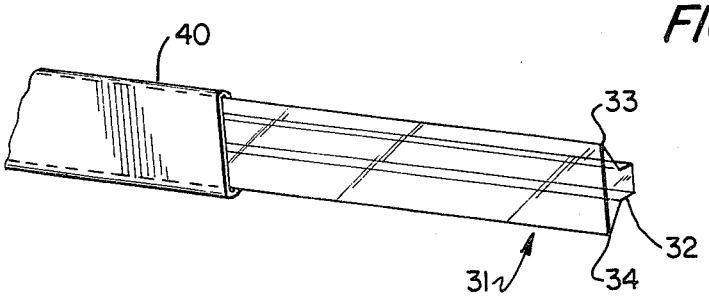
FIG. 4 is an enlarged, partial, perspective view of a rib and sleeve usable in the structure of FIGS. 1-2.

As more clearly shown in FIGS. 3 and 4, each rib includes a stem portion 32 and two laterally extending flange portions 33 and 34, the flanges in this embodiment being triangular in shape so that the overall rib has a generally Y-shaped configuration in cross section. Thus, the interval between two adjacent ribs constitutes a slot into which a strip member can be inserted longitudinally.

The structure includes a plurality of elongated strips 35, each of those strips also being made of either a polymeric material or a light metal. As illustrated in FIG. 1, at least some of the strips are provided with opaque and translucent regions forming alpha-numeric characters constituting the names of menu items available and the prices thereof. Preferably, the basic material employed for each of strips 35 is a translucent, but not transparent, material, a major portion of the surface being coated with an opaque layer by painting, anodizing or the like, which is omitted or cut-away to form characters such the letters and numbers 36 in FIG. 1. Thus, light passes through the areas forming the characters, and the remainder of the strip is dark.

As will be recognized, a plurality of strips can be placed between any two ribs 31, the strips being in longitudinal end-to-end relationship, and having any desired number of characters setting forth menu and price information. Those areas which are not to display any such information are simply filled with strips totally coated with the opaque substance so that those slots between ribs remain dark.

In order to continue the dark background appearance between those strips carrying information, the exposed portions of ribs 31 are provided with opaque sleeves 40 as illustrated in FIGS. 3 and 4, representations of the sleeves having been omitted from FIG. 2 because the size thereof is difficult to depict at the scale. Each of sleeves 40 is generally C-shaped in cross section, being formed from a relatively thin thermoformed material which retains its shape, that shape having been selected to that it mates with the shape of ribs 31. By longitudinally sliding the sleeves over exposed rib surfaces, the ribs are rendered essentially opaque and the continuity of the dark background is preserved between strips 35.

As will be observed in FIG. 2, it may be desirable to abbreviate the uppermost and lowermost ones of ribs 31, so that each has only one flange, although this is by no means necessary.

As previously indicated, it is desirable to be able to include pictorial representations of food items offered, and it is further desirable to be able to change these representations as the menu changes or, simply, for aesthetic purposes. It is, for example, undesirable to have a menu board which is occupied by only a few listed items and their prices, the remainder of the board being dark. Thus, with the apparatus of the present invention, it is possible to fill all areas unoccupied by menu listings with attractive pictures of the food items and then, as the menu expands and the number of items offered increases, to delete pictures as necessary, using the spaces previously occupied by the pictures for further listings of the new menu items. This is a particularly simple operation with the structure disclosed herein.

Figure 5:
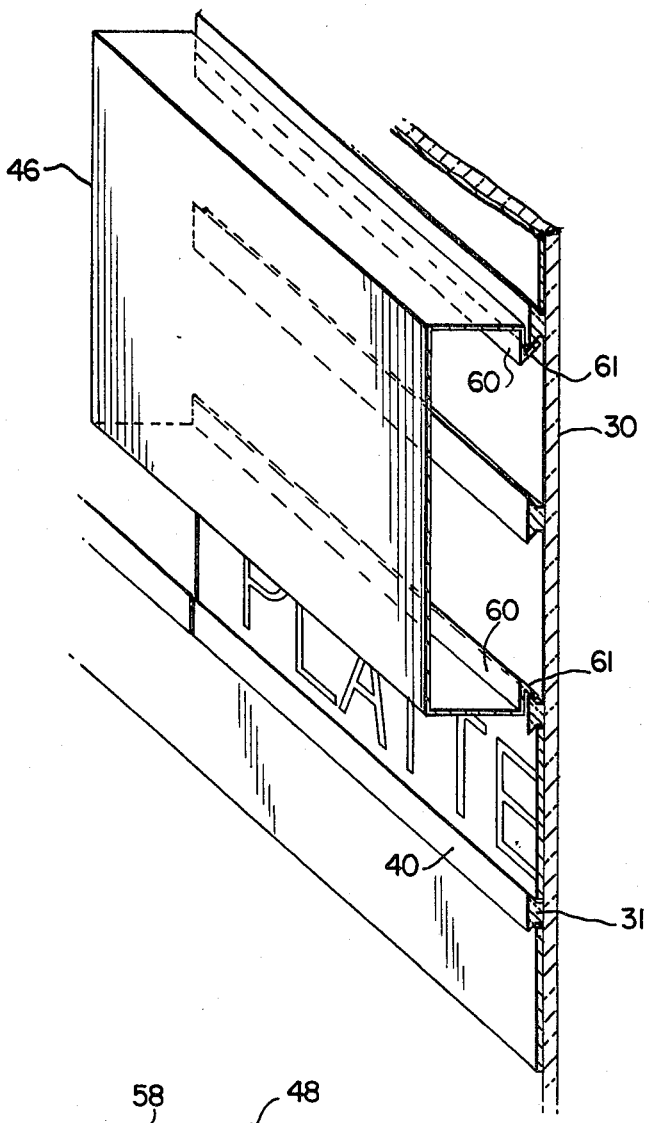
FIG. 5 is a partial perspective view of a variation of a structure in accordance with the invention.
Figure 6:
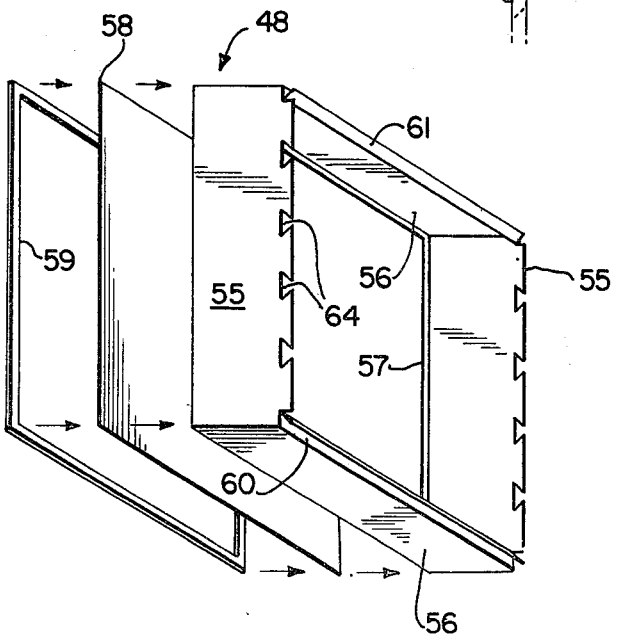
FIG. 6 is an exploded perspective view of a picture unit usable in the apparatus of FIGS. 1-5.

FIGS. 1 and 2 illustrate picture units of two different sizes, as examples, In the upper righthand corner of the menu board is a relatively small picture unit 42 and in the lower lefthand corner is a somewhat larger picture unit 44, units of different sizes being shown at 46 and 48 in FIGS. 5 and 6, respectively. As seen in FIGS. 3, 5 and 6 in detail, each picture unit constitutes a parallepiped having one open side, that side being the rear of the picture unit. Thus, as shown in FIG. 3, unit 44 includes upper and lower side walls 49, end walls 50 and a front panel which includes a translucent picture 51 and a frame structure to support the picture. The frame structure includes an inner rectangular frame portion 52, which is integrally formed with the side and end walls, and an outer frame 53 which comprises four relatively narrow strips, joined at the corners, the picture 51 being sandwiched between frame structures 52 and 53. This is best illustrated in the exploded view of FIG. 6 which shows a picture unit 48 having end walls 55, upper and lower side walls 56, and a frame structure 57, equivalent to frame structure 52 in FIG. 3. The picture 58 is sandwiched between frame structure 57 and the separate frame 59, which is equivalent to frame 53 in FIG. 3.

As will be recognized, pictures 51 or 58 are formed in a matter similar to a conventional photographic slide, the picture being generally translucent and having portions which transmit various colors, along with opaque areas, to present the representation of food items as illlustrated in FIG. 1. When lighted from behind, the picture becomes visible.

In order to attach the picture unit to the structure discussed above, each of the upper and lower side walls 49 (in FIG. 3) or 56 (in FIG. 6) is provided with means at the rear edges thereof defining hook members shaped to engage the flanges on two of ribs 31 attached to panel 30. As best seen in FIG. 3, upper wall 49 has a hook structure including an inwardly extending flange portion 60, which is integrally formed or attached to wall 49, and a rearwardly and outwardly extending flange portion 61 which extends at an acute angle from the distal edge of portion 60. As seen in FIGS. 5 and 6, these hook portions, in this embodiment, extend substantially continuously along the rearward edge of the upper and lower panels.

As will also be seen in FIGS. 2, 3 and 5, the picture units are dimensioned such that the spacing between upper and lower side walls 49 is chosen to be substantially equal to the distance between the centers of two ribs 31. This spacing can be the distance between any two ribs and is thus substantially equal to an integral multiple of the center-to-center distance between two adjacent ribs. This arrangement permits a picture unit of a variety of sizes to be constructed, depending upon the area to be occupied and the size of the picture to be displayed. A picture unit can be made, as with unit 42, to occupy the space between two adjacent ribs or, alternatively, could be made large enough to extend over the entire vertical extent of the sign, engaging the uppermost and lowermost ribs thereof.

As seen in FIGS. 3 and 6, end walls 50 or 55 are provided to prevent light escape through the ends of the picture unit, those end walls, as well as the side walls, being opaque. In order to complete this light blocking function to the extent possible, the end walls are provided with notches 64, shaped to generally conform to the shape of ribs 31, permitting the picture to be longitudinally and slidably mounted on the ribs. The ribs between those engaged by hook members 60, 61 preferably do not have opaque sleeves 40 mounted thereon so that light from units 16, 17 and 18 can pass through panel 30 and the ribs behind the picture to avoid the creation of shadows on the picture. However, as illustrated in FIG. 3, sleeves 40 can extend into and slightly beyond the end walls to block light from passing through the ribs adjacent those end walls.

As can be seen in the partial perspective view of FIG. 5, various arrangements of picture units, menu item strips and blank strips can be arranged so that, as viewed from the front, the entire board presents a substantially uniform dark background appearance except for those areas of the strips rendered intentionally translucent to form alphanumeric characters, and except for the translucent portions of the pictures. Picture and menu item strips can readily be rearranged or changed simply by slipping the units longitudinally to an end of the menu board to remove articles and sliding new strips, opaque sleeves and picture units in from the end. Additionally, the picture units themselves can be made changeable by attaching the frame portions thereof together using removable fasteners. Alternatively, adhesives can be used.

Figure 7:
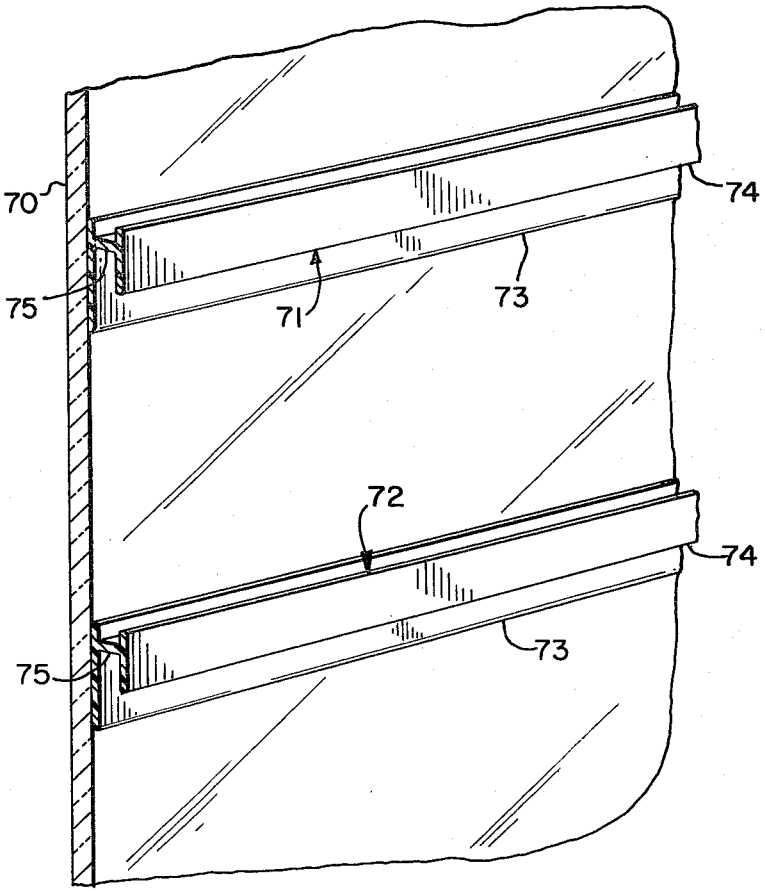
FIG. 7 is a partial perspective view, in section, of a further embodiment of a menu board in accordance with the invention.

A further embodiment of a sign structure in accordance with the invention is shown in FIGS. 7–12. As seen in FIG. 7, the structure includes a translucent front panel 70, which is equivalent to panel 30 in the previous embodiment, and a plurality of substantially parallel ribs 71, 72 adhered to the front or outer surface of panel 70. The ribs are shaped somewhat differently from those of the embodiment previously described, each rib including an elongated rectangular strip 73 which is adhered to panel 70, a narrower elongated strip 74 which is narrower than strip 73 and is held in parallel spaced relationship with respect to strip 73 by a perpendicularly extending rather narrow strip 75. These ribs are preferably unitarily formed as extruded polymeric members and are also preferably formed from an opaque material.

Figure 8:
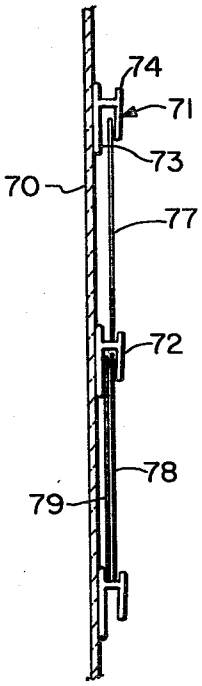
FIG. 8 is a side elevation, in section, of the structure of FIG. 7.

As illustrated in FIG. 8, the ribs are arranged such that indicia-bearing cards or strips 77, 78 and 79 can be inserted between adjacent ones of the ribs, the information-bearing strips being dimensioned so that they can be inserted between the ribs by placing the top edge of a strip 77, for example, in the space between the downwardly extending portions of strips 73 and 74 on one rib and then between the upwardly extending portions of those strips in the next lower rib. As shown with strips 78 and 79, the spacing between strips 73 and 74 is such that more than one information bearing strip can be placed between adjacent ribs. Thus, a strip which is opaque and has transparent portions spelling out the name of a menu item can be placed between the ribs and then, at the end thereof, a shorter strip bearing price information can be inserted with the ends of the strips overlapping so that no light gap exists between the ends thereof. Tape can also be used of abutting ends leave a gap.

Figure 10:
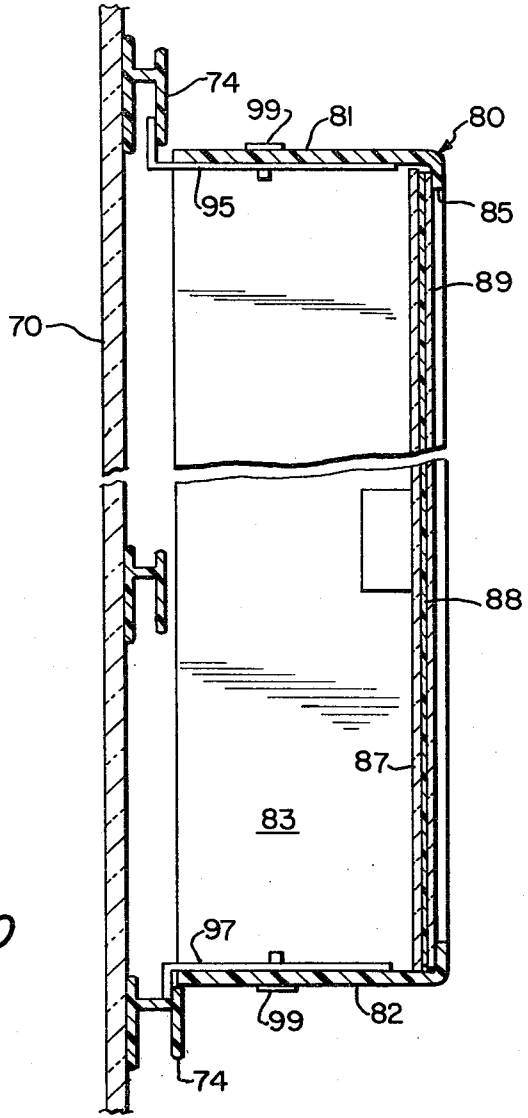
FIG. 10 is a partial side elevation, in section, of the picture module of FIG. 9 used with the menu board embodiment of FIGS. 7 and 8.
Figure 9:
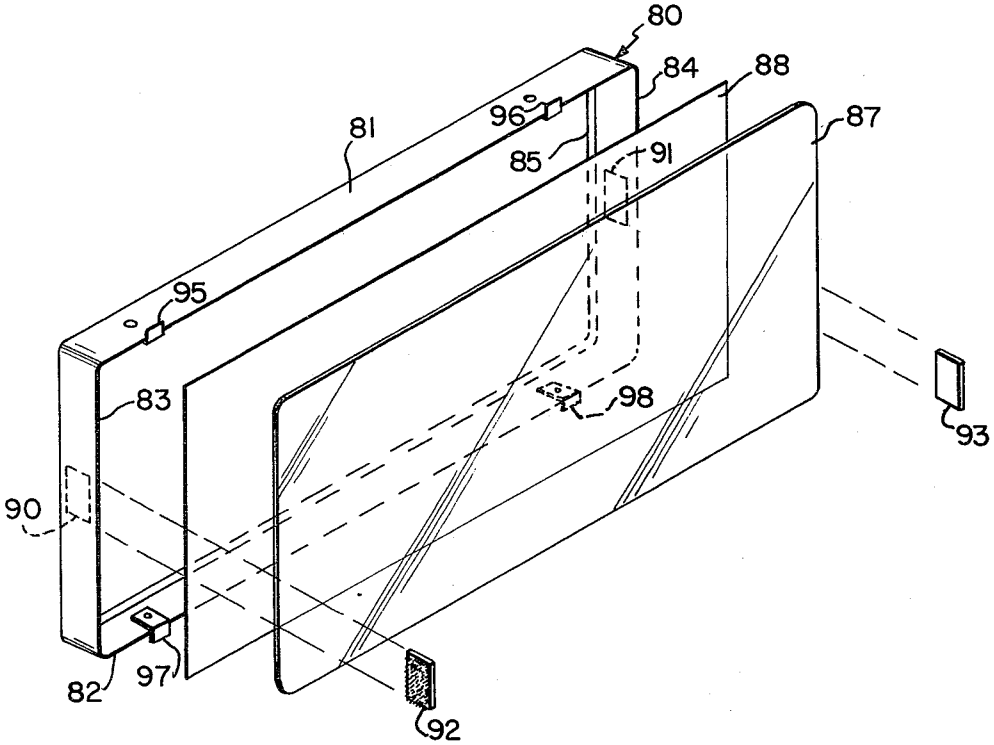
FIG. 9 is an exploded perspective view of a further embodiment of a picture module in accordance with the invention.
Figure 11:
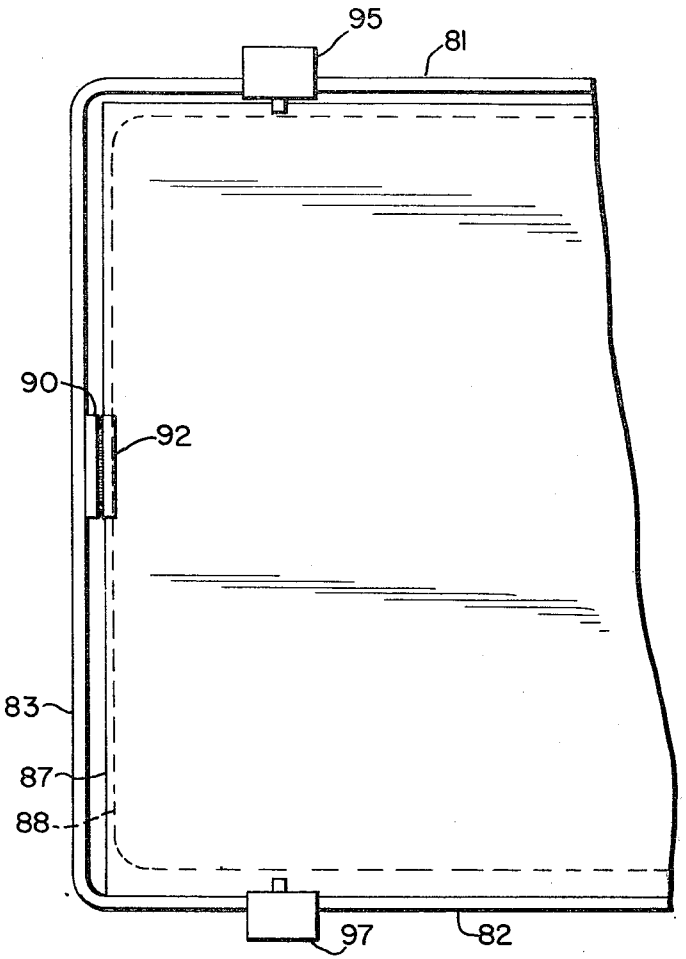
FIG. 11 is a partial rear elevation of the structure of FIG. 10.

A picture unit usable in conjunction with this embodiment of the apparatus is illustrated in FIGS. 9, 10 and 11. The picture unit includes a box-like structure indicated generally at 80 having parallel top and bottom walls 81, 82 and parallel end walls 83, 84. The back of this structure is completely open and the front thereof is open except for a relatively narrow inwardly extending frame 85 which lies in a single plane and extends inwardly from the front edges of walls 81–84. Walls 81–84 are preferably about 1.5 inches.

The picture unit also includes a sheet 87 of relatively stiff transparent polymeric material, sheet 87 being cut and shaped so that it fits loosely within the cavity defined by walls 81–84, the outer dimensions of sheet 87 being larger than the opening defined by frame 85. Sheet 87 and frame 85 are designed to hold between them a picture 88 which is in the form of a translucent sheet having regions of varying color and light tranmissivity, forming the desired picture which can be backlighted. These components are shown assembled in FIG. 10, and it will also be noted in FIG. 10 that an additional transparent sheet 89 can be inserted between the picture 88 and frame 85 if additional stiffening is necessary to support the picture sheet.

In order to hold the planar sheets thus described in position, side wall 83 and 84 are provided with hook and loop fasteners such as those sold under the trademark VELCRO. As seen in FIGS. 9, 10 and 11, relatively small rectangular pads 90 and 91 of either the hook or loop portion of mating pairs of material of this type are adhered to the inner surfaces of walls 83 and 84, spaced from the inner surface of frame 85 a distance sufficient to permit sheets 87, 88 and, if used, 89 between the fastener pad and frame 85. After the sheets are inserted against the inner surface of frame 85, mating pads 92 and 93 are pressed onto pads 90 and 91, forming a pad of material which protrudes from walls 83 and 84 a distance sufficient to engage the side edges of sheet 87, thereby keeping the sheets from falling backward into the cavity within picture unit 80. As will be readily apparent, changing the picture is a very simple process, necessitating only the removal of pads 92 and 93 and of sheet 87 to replace picture 88 with a new one.

Upper and lower walls 81 and 82 of the picture unit are provided with L-shaped clips 95, 96, 97 and 98, each clip having a long leg which is fastened to the inner surface of the associated one of walls 81 or 82 by one or more fasteners such as rivets 99. Short legs of the hooks extend outwardly perpendicular to walls 81 and 82 and are engageable with oppositely facing legs of strip portions 74 of any two of ribs 71, 72 attached to panel 70. As in the previously described embodiment, the height of the box is chosen to be equal to the gap between an integral number of ribs. It will be observed that the upwardly and downwardly extending legs of clips 95–98 are not exactly symmetrical, permitting the upper leg to be inserted first, after which the downwardly extending legs can be swung past the lower rib, and then allowed to rest in the position shown in FIG. 10.

Figure 12:
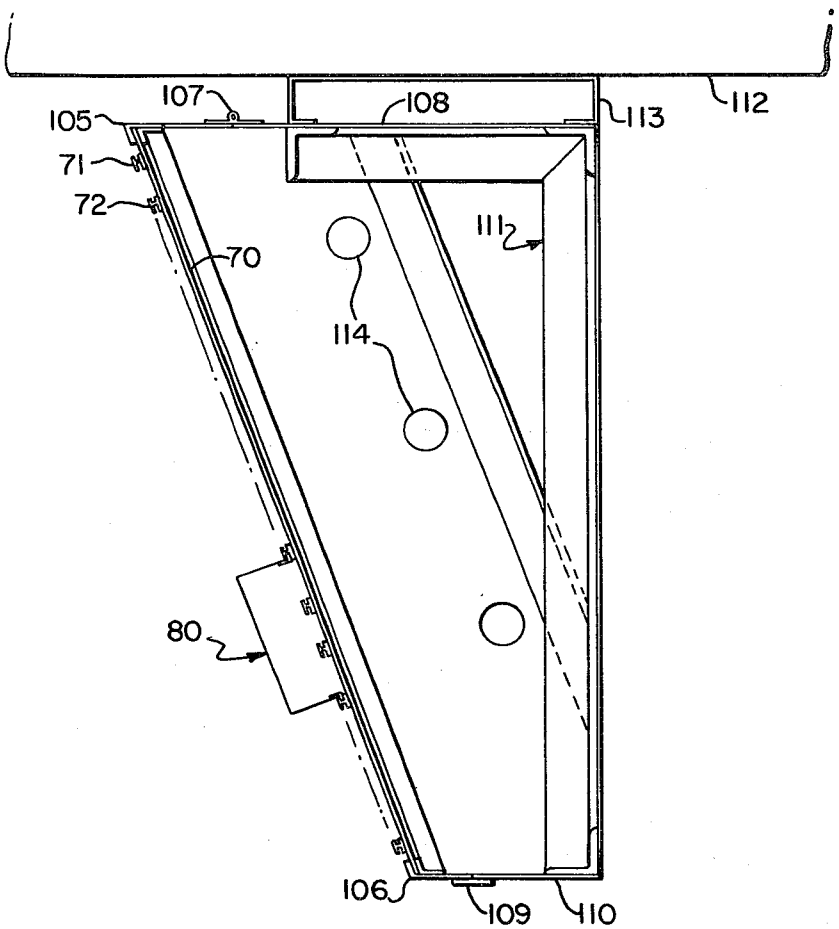
FIG. 12 is an illustration of the assembled sign according to the second embodiment.

FIG. 12 illustrates an assembled sign in accordance with the second embodiment heretofore described. As seen therein, front panel 70 is retained at the top and bottom in angled frame members 105 and 106, upper frame member 105 being attached to a hinge 107 the other side of which connected to a fixed roof portion 108. Bottom frame member 106 is connected by any conventional latch device 109 to a floor member 110, members 108 and 110 being connected to a conventional frame structure indicated generally at 111. The entire apparatus is supported on a structural portion of the building 112 by a suspending channel 113. Light units 114 are spaced within the housing formed by the top and bottom walls and similar trapazoidal side walls, the hinging of the front panel and associated frame members being provided to permit replacement of the fluorescent element conforming the light units.

In a typical unit, the overall slant height of panel 70 is in the order of 27 inches and ribs 71, 72 are equal distantly spaced at about 1⅝ inches, center-to-center. With this arrangement, spacing the light units 114 approximately 4 inches or more behind panel 70 prevents the appearance of shadows from any of strips 71, 72 from appearing on the back of picture units behind which they extend.

While certain advantageous embodiments have been chosen to illustrate the invention it will be understood by those skilled in the art that various changes and modifications can be made therein without departing from the scope of the invention as defined in the appended claims.

What is claimed is:

1. An illuminated sign structure, comprising a housing having an opaque frame and a translucent front panel within said frame;

a source of light mounted in said housing;

a plurality of substantially parallel ribs mounted on the outer surface of said front panel and extending across said panel in equally spaced relationship, said ribs each having, in cross section, a stem portion protruding outwardly from said panel and lateral flanges extending in opposite directions from said stem portion, said flanges being spaced from said outer surface and having opaque front surfaces;

a plurality of elongated strips each having a width no greater than the distance between said stem portions of adjacent ones of said ribs and a thickness no greater than the spacing between said outer surface and said flanges such that each of said strips can be inserted between adjacent ones of said ribs, at least some of said strips having opaque and translucent regions defining alphanumeric characters; and a plurality of picture display units, each said unit having end walls, upper and lower spaced, generally parallel side walls, and a front panel, the rear of each said unit being substantially open, said front panel of each unit having translucent portions forming a pictorial representation of an object, each of said upper and lower side walls having means at the rear edges thereof defining outwardly extending hook members shaped to engage flanges which extend toward each other on two of said ribs, said side walls of said picture display units being spaced apart by different distances, each said distance being substantially equal to an integral multiple of the center-to-center distance between said ribs;

whereby a plurality of said strips and picture display units can be mounted on said frame front panel to occupy substantially all of the area within said frame to permit passage of light only through said translucent regions of said strips and translucent portions of said display units.

2. a structure according to claim 1 wherein said ribs are translucent and the structure further includes a plurality of opaque sleeve members each having a generally C-shaped cross section to engage the flanges on a rib and to cover the exposed front surface thereof.

3. A structure according to claim 1 wherein each of said hook members includes a first flange portion extending perpendicularly inwardly from the rear edge of a side wall, and a second flange portion extending rearwardly and outwardly at an acute angle from the distal edge of said first flange portion.

4. A structure according to claim 1 wherein each of said lateral flanges on said ribs is triangular in cross section such that two said lateral flanges form, with one said stem, a rib having a generally Y-shaped cross section.

5. A structure according to claim 4 wherein each of said hook members includes a first flange portion extending perpendicularly inwardly from the rear edge of a side wall, and a second flange portion extending rearwardly and outwardly at an acute angle from the distal edge of said first flange portion.

6. A structure according to claim 1 wherein said ribs are opaque.

7. A structure according to claim 6 wherein each of said hook members includes an L-shaped bracket having one leg attached to a side wall of said picture display unit and the other leg extending perpendicularly outwardly therefrom.

8. A structure according to claim 7 wherein each of said ribs comprises first and second elongated rectangular strips, said stem comprising a web perpendicular to and between said first and second strips holding said strips in parallel spaced relationship.

9. A structure according to claim 1 wherein said end and side walls of said display units are opaque.

* * * * *